US009903356B2

(12) United States Patent
Lee

(10) Patent No.: US 9,903,356 B2
(45) Date of Patent: Feb. 27, 2018

(54) COMPRESSOR AND DISCHARGING MUFFLER THEREOF

(71) Applicant: Dongbu Daewoo Electronics Corporation, Seoul (KR)

(72) Inventor: Yong Seok Lee, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 504 days.

(21) Appl. No.: 14/169,129

(22) Filed: Jan. 30, 2014

(65) Prior Publication Data

US 2015/0176576 A1 Jun. 25, 2015

(30) Foreign Application Priority Data

Dec. 24, 2013 (KR) ..... 10-2013-0162009

(51) Int. Cl.
*F04B 39/00* (2006.01)
*F04B 53/00* (2006.01)

(52) U.S. Cl.
CPC ..... *F04B 39/0027* (2013.01); *F04B 39/0055* (2013.01); *F04B 39/0061* (2013.01); *F04B 53/001* (2013.01)

(58) Field of Classification Search
CPC ..... F04B 39/0055–39/0061; F04B 39/0072; F04B 39/0027; F04B 53/001; F04C 29/06; F04C 29/065; F04C 29/066; F04D 29/663; F04D 29/665
USPC ..... 181/403, 175, 279, 280, 212; 417/312, 417/540, 542
See application file for complete search history.

(56) References Cited

U.S. PATENT DOCUMENTS 4,401,418 A * 8/1983 Fritchman ..... F04B 39/0055 181/403
5,452,991 A * 9/1995 Kita ..... F04B 39/0055 181/403
6,296,457 B1 10/2001 Shintoku et al.
2006/0275150 A1 12/2006 Barth
2010/0209280 A1 8/2010 Flannigan et al.

FOREIGN PATENT DOCUMENTS

KR 10-2009-0011380 2/2009
KR 10-2013-0129790 11/2013

OTHER PUBLICATIONS

Korean Intellectual Property Office (KIPO), English Abstract for Korean Patent Publication No. 10-2013-0129790, dated Nov. 29, 2013, http://kpa.kipris.or.kr/kpa/.

* cited by examiner

*Primary Examiner* — Alexander Comley

(57) ABSTRACT

A discharge muffler may include a discharge space in the cylinder block and a pulsation and/or noise reducing member (e.g., a pulsation reducing member) engaged in the discharge space having a passage (e.g., a pulsation and/or noise reducing passage) on a circumferential surface configured to guide the working fluid to an inner space of the discharge space.

10 Claims, 4 Drawing Sheets

COMPRESSOR AND DISCHARGING MUFFLER THEREOF

CROSS-REFERENCE TO RELATED APPLICATIONS

This application is based on and claims priority from Korean Patent Application No. 10-2013-0162009, filed on Dec. 26, 2013, the disclosure of which is incorporated herein in its entirety by reference.

TECHNICAL FIELD

The present disclosure relates to a compressor and a discharge muffler of the compressor.

BACKGROUND

There have been various compressors for use in a refrigerators (e.g., a reciprocating compressor, a rotary compressor, and a turbo compressor) which serve to circulate a compressed gas refrigerant within the refrigerator. The reciprocating compressor may compress the gas refrigerant through a reciprocating movement of a piston, while the rotary compressor may compress gas refrigerant by rotating a rotator in a cylinder. Further, the turbo compressor may compress the gas refrigerant by converting a velocity energy to a pressure energy using the centrifugal force of an impeller.

While the compressor repeats a cycle of suction or vacuum, compression and discharge of the gas refrigerant according to the compression stroke of the piston, pulses (e.g., a pulsation) may be generated in the compressor. The pulsation of the gas refrigerant causes noise in the compressor. Therefore, to alleviate the noise, a discharge muffler that reduces a pressure variation is provided at a discharge passage of the compressor.

The discharge muffler may mitigate the gas pressure, thus reducing the noise by expanding the gas refrigerant or extending the flow path of the gas refrigerant.

Recently, there has been proposed a discharge muffler in which two discharge spaces are connected to each other. The discharge muffler may serve to reduce pulsation of the gas refrigerant by increasing the capacity of the muffler through the two discharge spaces.

However, the discharge muffler is installed in a limited space within the compressor, thereby making it difficult to increase the volume of the discharge spaces. This hinders pulsation reducing performance in the compressor.

Korean Patent Application Publication No. 10-2013-0129790 (published on Nov. 29, 2013) may disclose a conventional compressor.

SUMMARY

Embodiments of the present disclosure provide a compressor and a discharge muffler configured to reduce a pulsation component of working fluid and/or noise of the compressor.

According to an aspect of the present disclosure, a discharge muffler of a compressor configured to reduce pulsation and/or noise may include: at least one discharge space in a cylinder block; and a pulsation reducing member (e.g., a pulsation and/or noise reducing member) engaged in the discharge space having a passage (e.g., a pulsation and/or noise reducing passage), on a circumferential surface, configured to guide the flow of the working fluid to an inner space of the discharge space.

According to an aspect of the present disclosure, a compressor may include an inhalation muffler configured to supply working fluid; a cylinder block having a cylinder; a cylinder head coupled to the cylinder block to seal the cylinder; a valve assembly between the cylinder block and the cylinder head configured to control a flow of the working fluid; and a discharge muffler configured to receive the working fluid from the valve assembly, wherein the discharge muffler comprises: at least one discharge space in the cylinder block; and a pulsation and/or noise reducing member (e.g., a pulsation reducing device) in the discharge space having a passage (e.g., a pulsation and/or noise reducing passage), or in a circumferential surface thereof, configured to guide the flow of the working fluid into the discharge space.

According to embodiments of the present disclosure, a pulsation and/or noise producing component of the working fluid may be reduced by increasing a flow distance or path of the working fluid through the passage (e.g., a pulsation and/or noise reducing passage).

According to an aspect of the present disclosure, a pulsation and/or noise component of the working fluid may be reduced by elongating the path of the working fluid through the passage (e.g., a pulsation and/or noise reducing passage) and making the path bend in varying directions (e.g., upward and downward).

DETAILED DESCRIPTION

Figure 1:
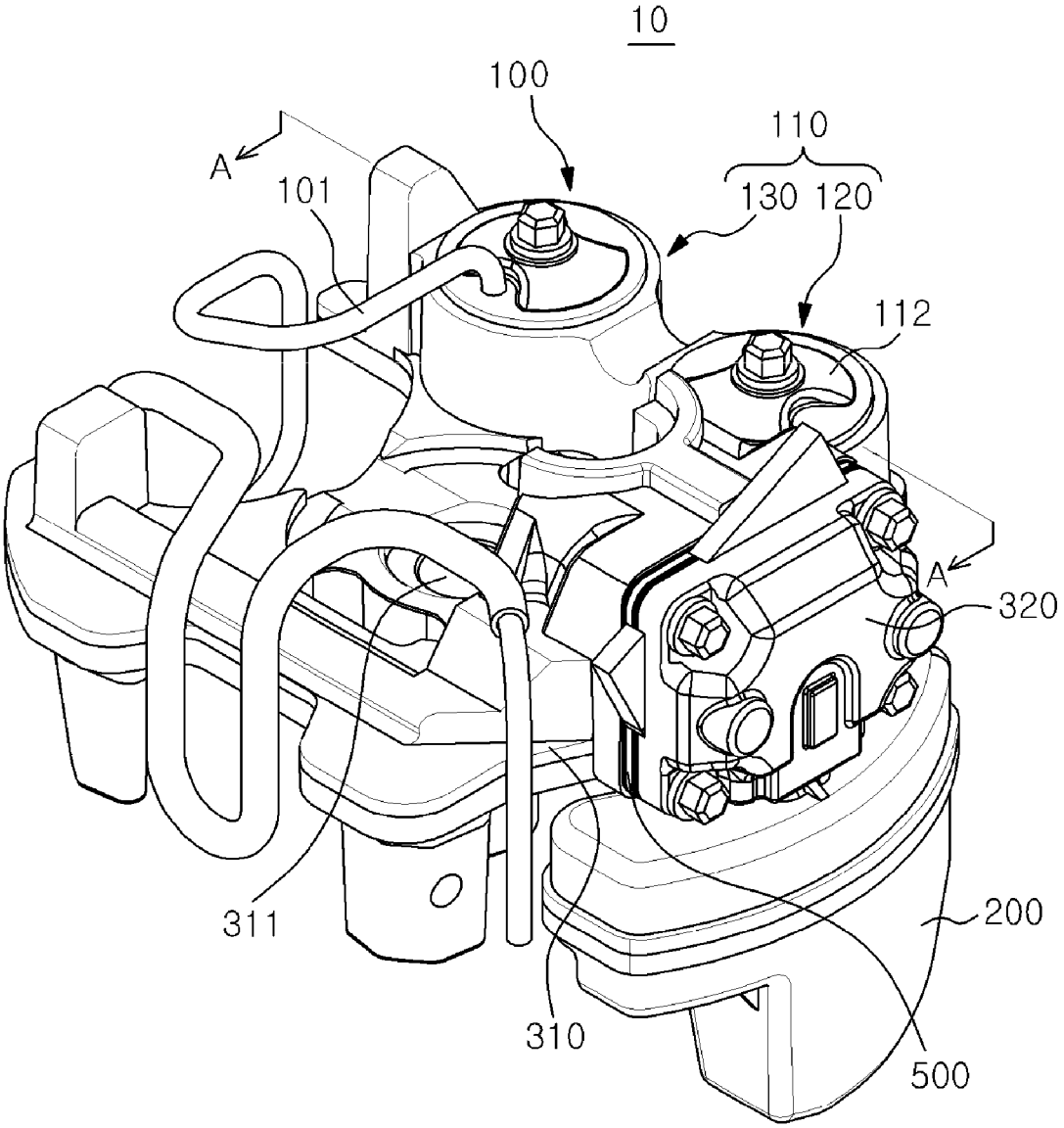
FIG. 1 is a perspective view of an exemplary compressor according to one or more embodiments of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

One or more exemplary embodiments of the present disclosure will be described more fully hereinafter with reference to the accompanying drawings, in which one or more exemplary embodiments of the disclosure can be easily determined by those skilled in the art. As those skilled in the art will realize, the described exemplary embodiments may be modified in various different ways, all without departing from the spirit or scope of the present disclosure, which is not limited to the exemplary embodiments described herein.

It is noted that the drawings are schematic and are not necessarily dimensionally illustrated. Relative sizes and proportions of parts in the drawings may be exaggerated or reduced in their sizes, and a predetermined size is just exemplary and not limiting. The same reference numerals designate the same structures, elements, or parts illustrated in two or more drawings in order to exhibit the same or similar characteristics.

The disclosed embodiments of the present disclosure illustrate ideal embodiments of the present disclosure in more detail. As a result, various modifications of the drawings are expected. Accordingly, the exemplary embodiments are not limited to a specific form of the illustrated region, and for example, include modifications of form (e.g., by manufacturing).

Figure 2:
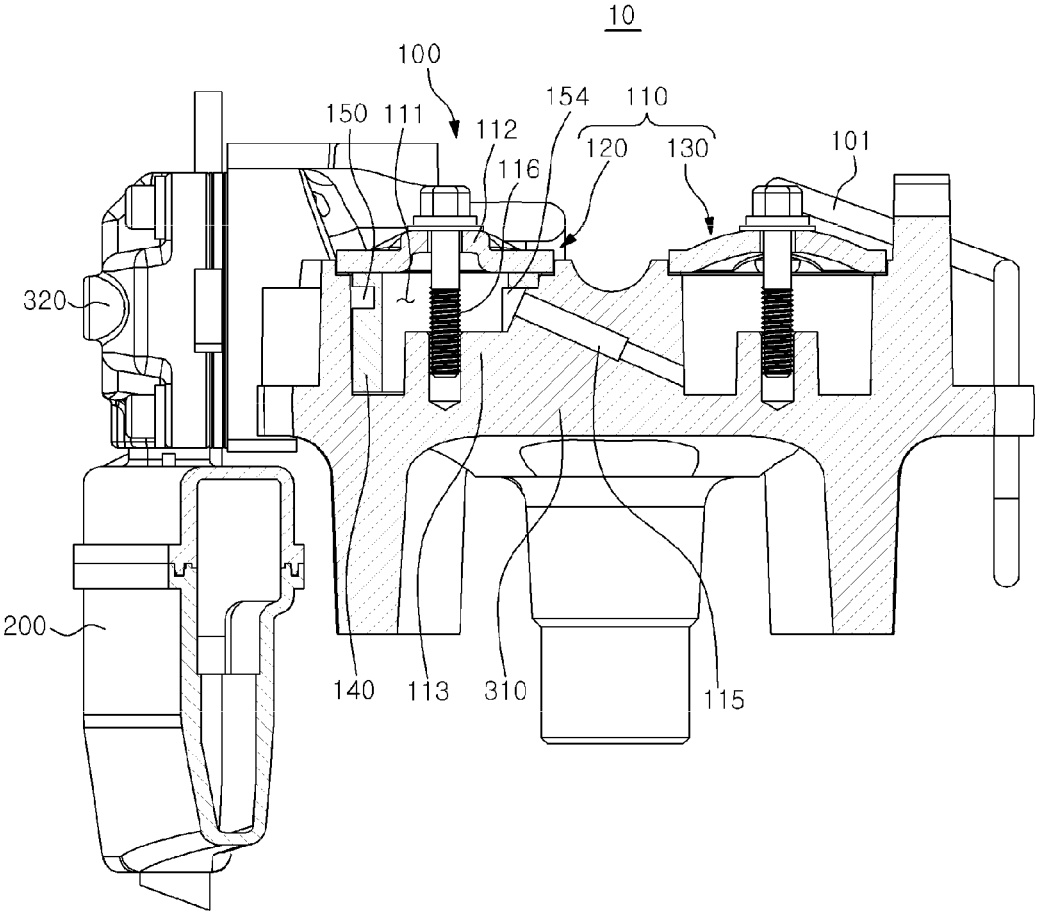
FIG. 2 is a longitudinal sectional view taken along line "A-A" of FIG. 1 according to one or more embodiments of the present disclosure.
Figure 3:
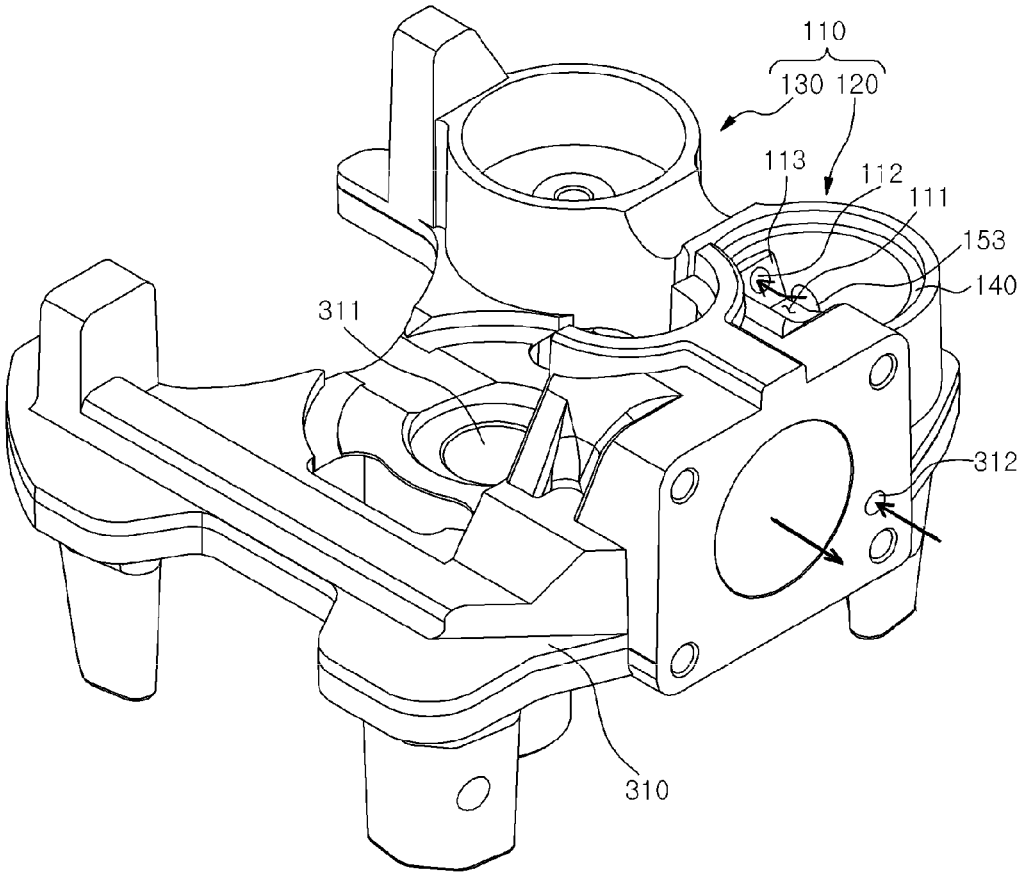
FIG. 3 is a perspective view of an exemplary cylinder block according to one or more embodiments of the present disclosure.

FIG. 1 is a perspective view of an exemplary compressor according to one or more embodiments of the present disclosure, FIG. 2 is a longitudinal sectional view taken along line "A-A" of FIG. 1 according to one or more embodiments of the present disclosure, and FIG. 3 is a perspective view of an exemplary cylinder block according to one or more embodiments of the present disclosure.

Referring to FIGS. 1 through 3, a compressor 10 according to embodiment(s) of the present disclosure may include a vacuum muffler 200, a cylinder block 310, a cylinder head 320, a discharge muffler 100, and a valve assembly 500.

The vacuum muffler 200 may provide working fluid from a pipe (e.g., a vacuum pipe; not illustrated) to a cylinder 311 of the cylinder block 310 through the valve assembly 500. Herein, the pipe may receive the working fluid from outside of the compressor 10 and provide the received working fluid to the vacuum muffler 200.

In various embodiments, the compressor 10 is an enclosed reciprocating compressor employed in a refrigerator, and the working fluid may be a refrigerant used in generating cool air necessary for the refrigerator. Also, the pipe may transfer the refrigerant from an evaporator to the vacuum muffler 200.

The cylinder block 310 may include the cylinder 311 in which a movable and/or reciprocating piston (not illustrated) is installed. The cylinder 311 may communicate with the vacuum muffler 200 or the discharge muffler 100 via the valve assembly 500.

That is, when the piston moves from a top dead center to a bottom dead center of the cylinder 311, an inner pressure of the cylinder 311 becomes negative (e.g., under vacuum), and the working fluid inside the vacuum muffler 200 may enter the cylinder 311 via the valve assembly 500. When the piston moves from the bottom dead center to the top dead center of the cylinder 311, the pressure of the cylinder 311 becomes positive (e.g., greater than atmospheric pressure), and the working fluid inside the cylinder 311 may be discharged to the discharge muffler 100 via the valve assembly 500 and an inlet hole 312 of the cylinder block 310.

Herein, the top dead center may be a point where the piston is an upper limit of the cylinder 311, and the bottom dead center may be a point where the piston is at a lower limit of the cylinder 311.

The cylinder block 310 may include the inlet hole 312 through which the working fluid of the valve assembly 500 enters. The inlet hole 312 may communicate with a discharge space 110 of the discharge muffler 100. In more detail, the inlet hole 312 may be in fluid contact or communication with an inlet portion 151 of a pulsation reducing member 140 shown in FIG. 4.

The cylinder head 320 may be coupled to the cylinder block 310 to seal the cylinder 311. The valve assembly 500 may be between the cylinder block 310 and the cylinder head 320.

The valve assembly 500 may be configured to control a flow of the working fluid by a pressure difference of the cylinder 311. According to one or more embodiments, when the pressure of the cylinder 311 is negative, the valve assembly 500 may guide the flow of the working fluid from the vacuum muffler 200 towards the cylinder 311. When the pressure of the cylinder 311 is positive, the valve assembly 500 may guide the flow of the working fluid from the cylinder 311 towards the discharge muffler 100.

Figure 4:
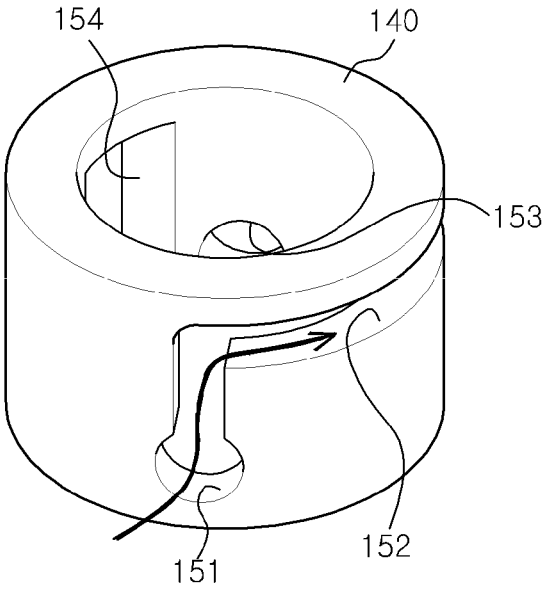
FIG. 4 is a perspective view of an exemplary a pulsation and/or noise reducing device, viewed from an inlet side through which working fluid enters, according to one or more embodiments of the present disclosure.
Figure 5:
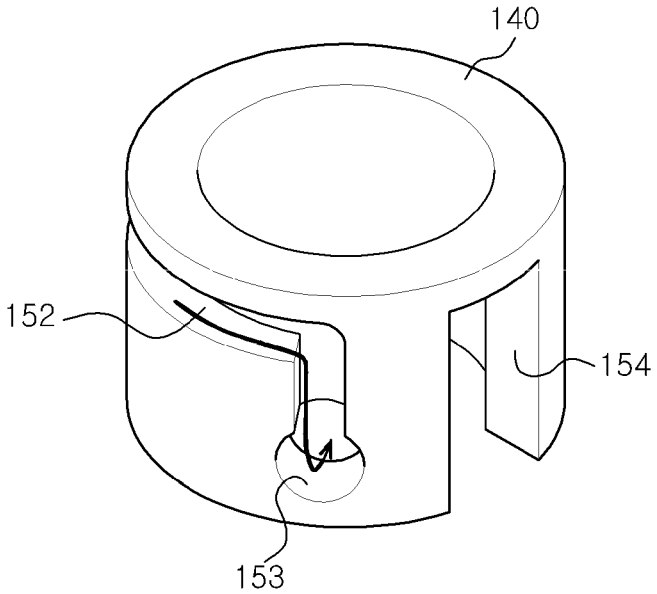
FIG. 5 is a perspective view of an exemplary a pulsation and/or noise reducing device, viewed from an outlet side through which working fluid is discharged, according to one or more embodiments of the present disclosure.

FIG. 4 is a perspective view of an exemplary pulsation and/or noise reducing member, viewed from an inlet side through which working fluid enters, according to one or more embodiments of the present disclosure, and FIG. 5 is a perspective view of an exemplary pulsation and/or noise reducing member, viewed from an outlet side through which working fluid is discharged, according to one or more embodiments of the present disclosure.

Referring to FIGS. 4 and 5, the discharge muffler 100 reduces noise and/or pulsation of the working fluid, and may include a discharge space 110 and a pulsation and/or noise reducing member 140.

The discharge space 110 is in the cylinder block 310 and is connected to and may communicate with the inlet hole 312 of the cylinder block 310. Therefore, the working fluid of the valve assembly 500 may flow into the discharge space 110 through the inlet hole 312.

The discharge space 110 may include a first discharge space 120 and a second discharge space 130. The first discharge space 120 and the second discharge space 130 may be in parallel in the cylinder block 310 and may be connected and/or communicate with each other through a connection passage 115. A pulsation and/or noise reducing member (e.g., a pulsation reducing member) 140 may be in the first discharge space 120, and a discharge pipe 101 may be connected to the second discharge space 130.

It should be understood that the exemplary embodiments of the present disclosure described above with references to the accompanying drawings and the first discharge space 120 and the second discharge space 130, are not limiting, but only an example in all respects. The present disclosure is not limited to the disclosed number of discharge spaces.

A chamber 111 for receiving the working fluid may be in the first discharge space 120. A hook jaw 113 may be in the chamber 111. The hook jaw 113 may engage or interface with a recess 154 of the pulsation reducing member 140. A cover 112 may be mounted to an upper portion of each of the first discharge space 120 and the second discharge space 130, and the discharge pipe 101 may be connected to the cover 112 of the second discharge space 130. The cover 112 may be coupled to the discharge space 110 by a fixture 116, and the discharge pipe 101 may supply the working fluid of the second discharge space 130 to a condenser (e.g., of a refrigerator not illustrated).

The pulsation reducing member 140 may be mounted to at least one of the discharge spaces, the first discharge space 120 and/or the second discharge space 130. In this embodiment, for example, the pulsation reducing member 140 is provided only in the first discharge space 120.

The pulsation reducing member 140 may be accommodated in the chamber 111. In one or more embodiments, the pulsation reducing member 140 may be have a cylindrical shape to include a space where the working fluid may be received. In one or more embodiments, the pulsation reducing member 140 has the shape of a hollow cylinder, and the hollow space of the pulsation reducing member 140 forms a portion of the chamber 111.

A passage (e.g., a pulsation and/or noise reducing passage) 150 may be in a circumferential surface of the pulsation reducing member 140. The passage 150 may provide a traveling path to guide the flow of the working fluid supplied to the discharge space 110. Specifically, the passage 150 may extend the traveling length of the working fluid and/or reduce the flow velocity of the working fluid. This results in the alleviation of noise from vibrations in the compressor 10. The length, sectional area and shape of the passage 150 may be adjusted according to pulsation characteristics of the compressor.

In detail, the passage 150 may have an inlet portion 151, a guide portion 152, and a discharge portion 153. The inlet portion 151 is on an entrance side of the pulsation reducing member 140 through which the working fluid enters. The inlet portion 151 may have a groove shape and/or adapted to receive the working fluid that enters through the valve assembly 500. The inlet unit 151 may be connected to and/or communicate with the inlet hole 312 of the cylinder block 310. The guide portion 152 may be or comprise a long groove extending along a circumferential surface of the pulsation reducing member 140 to guide the working fluid that enters into the inlet portion 151 along the circumferential surface of the pulsation reducing member 140. The discharge portion 153 may penetrate towards the chamber 111 of the pulsation reducing member 140 from an end of the guide portion 152 to guide the working fluid flowing along the guide portion 152 into the pulsation reducing member 140 (e.g., the chamber 111 of the discharge space 110).

The recess 154 may be in the pulsation reducing member 140. Since the recess 154 engage or interfaces with the hook jaw 113 of the discharge space 110 when the pulsation reducing member 140 is in the discharge space 110, the pulsation reducing member 140 may be in a predetermined position of the discharge space 110. Herein, the recess 154 may be between the inlet portion 151 and the discharge portion 153.

Operations of the compressor according to one or more embodiments having the above configuration(s) will be described.

When the piston of the compressor 10 moves from the bottom dead center to the top dead center of the cylinder 311, the inner pressure of the piston becomes positive, and thus the working fluid of the cylinder 311 may enter into the inlet hole 312 of the cylinder block 310 through the valve assembly 500.

The working fluid entering into the inlet hole 312 may be discharged to the chamber 111 of the first discharge space 120 along the inlet portion 151, the guide portion 152, and the discharge portion 153 of the pulsation reducing member 140. The working fluid in the first discharge space 120 flows into the second discharge space 130 through the connection passage 115 and then flows into the condenser through the discharge pipe 101.

Although exemplary embodiments of the present disclosure are described above with reference to the accompanying drawings, those skilled in the art will understand that the present disclosure may be implemented in various ways without changing the necessary features or the spirit of the present disclosure. For example, the guide portion or path may bend in various directions (e.g., up and down, like a square wave) and/or back and forth (e.g., similar to a letter "S") in any unused area of the pulsation reducing member 140.

Therefore, it should be understood that the exemplary embodiments described above are not limiting, but only an example in all respects. The scope of the present disclosure is expressed by claims below, not the detailed description, and it should be construed that all changes and modifications achieved from the meanings and scope of claims and equivalent concepts are included in the scope of the present disclosure.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure do not limit the present disclosure. The scope of the present disclosure will be interpreted by the claims below, and it will be construed that all techniques within the scope equivalent thereto belong to the scope of the present disclosure.

What is claimed is:

1. A discharge muffler for a compressor, the discharge muffler comprising:

at least one discharge space in a cylinder block; and a pulsation and/or noise reducing member in the discharge space and having a passage in an outer circumferential surface of the pulsation and/or noise reducing member, wherein the passage is configured to guide working fluid into the discharge space, the pulsation and/or noise reducing member has a cylindrical shape including a hollow space, wherein the passage comprises a guide portion, an inlet portion through which the working fluid enters, and a discharge portion penetrating through the pulsation and/or noise reducing member toward the hollow space, wherein the guide portion comprises a first groove extending toward a top portion of the pulsation and/or noise reducing member from the inlet portion, a second groove extending perpendicularly from the first groove along the outer circumferential surface and a third groove extending toward a bottom portion of the pulsation and/or noise reducing member from the second groove, wherein the pulsation and/or noise reducing member includes a recess, wherein the discharge space includes a hook jaw, and wherein the recess engages and/or interfaces with the hook jaw.

2. The discharge muffler of claim 1, wherein the discharge space comprises a first discharge space in which the working fluid enters through the pulsation and/or noise reducing member.

3. The discharge muffler of claim 2, wherein the discharge space comprises a second discharge space connected to and/or communicating with the first discharge space.

4. The discharge muffler of claim 3, further comprising a connection passage connecting the second discharge space to the first discharge space.

5. The discharge muffler of claim 1, wherein the passage is configured to reduce pulsation of the working fluid and/or reduce noise from the compressor.

6. A compressor comprising:

a vacuum muffler configured to supply working fluid;

a cylinder block having a cylinder;

a cylinder head coupled to the cylinder block and configured to seal the cylinder;

a valve assembly between the cylinder block and the cylinder head, configured to control a flow of the working fluid; and a discharge muffler through which the working fluid from the valve assembly enters, wherein the discharge muffler comprises:

at least one discharge space in the cylinder block; and a pulsation and/or noise reducing member in the discharge space and having a passage in an outer circumferential surface of the pulsation and/or noise reducing member configured to guide the working fluid in to the discharge space, the pulsation and/or noise reducing member has a cylindrical shape including a hollow space, wherein the passage comprises a guide portion, an inlet portion through which the working fluid enters, and a discharge portion penetrating through the pulsation and/or noise reducing member toward the hollow space, wherein the guide portion comprises a first groove extending toward a top portion of the pulsation and/or noise reducing member from the inlet portion, a second groove extending perpendicularly from the first groove along the outer circumferential surface and a third groove extending toward a bottom portion of the pulsation and/or noise reducing member from the second groove, wherein the pulsation and/or noise reducing member includes a recess, wherein the discharge space includes a hook jaw, and wherein the recess engages and/or interfaces with the hook jaw.

7. The compressor of claim 6, wherein the passage is configured to reduce pulsation of the working fluid and/or noise from the compressor.

8. The compressor of claim 6, wherein the discharge space comprises a first discharge space in which the working fluid enters through the pulsation and/or noise reducing member.

9. The compressor of claim 8, wherein the discharge space comprises a second discharge space connected to the first discharge space.

10. The compressor of claim 9, further comprising a connection passage connecting the second discharge space to the first discharge space.

* * * * *